US007450893B2

(12) United States Patent
Ahn et al.

(10) Patent No.: US 7,450,893 B2
(45) Date of Patent: Nov. 11, 2008

(54) ELECTROPHOTOGRAPHIC COLOR IMAGE FORMING APPARATUS HAVING A PLURALITY OF TRANSFER ROLLERS

(75) Inventors: Byung-sun Ahn, Suwon-si (KR); Jong-moon Eun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 331 days.

(21) Appl. No.: 11/243,318

(22) Filed: Oct. 5, 2005

(65) Prior Publication Data

US 2006/0099013 A1 May 11, 2006

(30) Foreign Application Priority Data

Nov. 5, 2004 (KR) ..... 10-2004-0089698

(51) Int. Cl.
*G03G 15/01* (2006.01)

(52) U.S. Cl. ..... 399/302; 399/299

(58) Field of Classification Search ..... 399/302, 399/303, 312, 313, 299
See application file for complete search history.

(56) References Cited

U.S. PATENT DOCUMENTS

| | | | | |
|---|---|---|---|---|
| 4,410,260 | A | 10/1983 | Kuehnle | |
| 5,469,248 | A * | 11/1995 | Fujiwara et al. | 399/313 |
| 6,463,247 | B1 * | 10/2002 | Kawano et al. | 399/299 |
| 6,470,166 | B2 * | 10/2002 | Mizoguchi et al. | 399/302 |
| 6,505,026 | B2 * | 1/2003 | Hayakawa et al. | 399/303 |
| 6,798,430 | B2 * | 9/2004 | Sato | 399/299 |
| 6,850,726 | B1 * | 2/2005 | Mizuno et al. | 399/299 |
| 6,957,034 | B2 * | 10/2005 | Saito et al. | 399/302 |
| 7,215,914 | B2 * | 5/2007 | Murakami et al. | 399/313 |
| 7,245,865 | B2 * | 7/2007 | Iwakura et al. | 399/302 |
| 2002/0003975 | A1 * | 1/2002 | Fujimori | 399/303 |
| 2002/0021920 | A1 * | 2/2002 | Hayakawa et al. | 399/303 |
| 2003/0175057 | A1 * | 9/2003 | Yasui et al. | 399/303 |
| 2003/0185602 | A1 * | 10/2003 | Sasamoto et al. | 399/299 |
| 2003/0215266 | A1 * | 11/2003 | Ishida et al. | 399/299 |
| 2003/0223784 | A1 * | 12/2003 | Yamanaka et al. | 399/299 |
| 2004/0109709 | A1 * | 6/2004 | Ishibashi et al. | 399/303 |
| 2004/0136758 | A1 * | 7/2004 | Kera et al. | 399/299 |
| 2005/0063739 | A1 * | 3/2005 | Kobayashi et al. | 399/299 |

(Continued)

FOREIGN PATENT DOCUMENTS

| | | |
|---|---|---|
| JP | 60-169862 | 9/1985 |

(Continued)

*Primary Examiner*—Susan S Lee
(74) *Attorney, Agent, or Firm*—Staas & Halsey LLP

(57) ABSTRACT

An electrophotographic color image forming apparatus, having: a plurality of photosensitive media; a plurality of transfer rollers respectively facing the plurality of photosensitive media; and a belt disposed between the photosensitive media and the transfer rollers and circulating while forming a plurality of transfer nips. When a length of the belt between two neighboring transfer nips is B and a distance between a pair of neighboring photosensitive media is C, B is larger than C, and when respective virtual lines connecting centers of the pair of photosensitive media and centers of corresponding transfer rollers are TP lines and a virtual line connecting the centers of the pair of neighboring photosensitive media is PP line, a pair of neighboring TP lines do not cross the PP line at right angles, and are slanted toward the same side to cross the PP line.

23 Claims, 4 Drawing Sheets

U.S. PATENT DOCUMENTS

2005/0271968 A1* 12/2005 Asano et al. ..... 399/302

FOREIGN PATENT DOCUMENTS

JP 4-78878 3/1992
JP 2001-100488 4/2001
JP 2001-166619 6/2001
JP 2002-91128 3/2002

* cited by examiner

ELECTROPHOTOGRAPHIC COLOR IMAGE FORMING APPARATUS HAVING A PLURALITY OF TRANSFER ROLLERS

CROSS-REFERENCE TO RELATED APPLICATIONS

This application claims the priority of Korean Patent Application No. 10-2004-0089698, filed on Nov. 5, 2004, in the Korean Intellectual Property Office, the disclosure of which is incorporated herein by reference.

BACKGROUND OF THE INVENTION

1. Field of the Invention

The present invention relates to an electrophotographic color image forming apparatus, and more particularly, to an electrophotographic color image forming apparatus including a plurality of photosensitive media, a belt contacting the photosensitive media, and a plurality of transfer rollers facing the photosensitive media as interposing the belt between them.

2. Description of the Related Art

An electrophotographic color image forming apparatus is an apparatus for printing an image by: scanning light onto a photosensitive medium that is charged to a predetermined potential to form an electrostatic latent image on an outer circumferential surface of the photosensitive medium; developing the electrostatic latent image by injecting a toner, that is, a developing agent, into a visible image of a predetermined color; and transferring the visible images of different colors onto paper and fusing the images on the paper. FIG. 1 shows a conventional electrophotographic color image forming apparatus.

Referring to FIG. 1, the conventional electrophotographic color image forming apparatus includes: a first photosensitive medium 10 and a second photosensitive medium 11; a first scanner 12 and a second scanner 13 scanning light onto the pair of photosensitive media 10 and 11; and four developers 15, 16, 17, and 18 receiving toners of four colors, that is, yellow (Y), cyan (C), magenta (M), and black (K) colors to form the color image by overlapping colors. The Y and C developers 15 and 16 face the first photosensitive medium 10, and the M and K developers 17 and 18 face the second photosensitive medium 11.

In addition, an intermediate transfer belt 20, on which the visible images formed on the photosensitive media 10 and 11 are transferred, is supported by a driving roller 21 and an idle roller 22 to be circulated, and proceeds while contacting lower portions of the pair of photosensitive media 10 and 11. A first transfer roller 25 and a second transfer roller 26 are formed so that transfer nips can be formed on respective contacting areas of the intermediate transfer belt 20 and the first and second photosensitive media 10 and 11. The first and second transfer rollers 25 and 26 respectively face the first and second photosensitive media 10 and 11 while interposing the intermediate transfer belt 20 between the rollers and the photosensitive media.

The color image formed on the intermediate transfer roller 20 by the overlapped transfer operations is transferred onto a sheet of paper (P) passing through the transfer nip between the intermediate transfer belt 20 and a third transfer roller 30. A transfer backup roller 23 is positioned adjacent to the third transfer roller 30 with the intermediate transfer belt 20 interposed therebetween, so that a transfer nip can be formed between the intermediate transfer belt 20 and the third transfer roller 30.

In the above conventional electrophotographic color image forming apparatus, a pair of photosensitive media 10 and 11 and a pair of transfer rollers 25 and 26 are pressed with each other. In addition, soft rollers having outer circumferential surfaces formed of elastic material such as rubber are used as the transfer rollers 25 and 26 to increase the width of the transfer nip.

Accordingly, pressure between the photosensitive media 10 and 11 and the intermediate transfer belt 20 increases, and irregular impact between the photosensitive media 10 and 11 and the intermediate transfer belt 20 increases, which causes a transfer defect and an image jitter. In addition, since the soft roller is used as the transfer roller, the fabrication costs increase, and it is difficult to maintain size accuracy of elements.

SUMMARY OF THE INVENTION

Additional aspects and/or advantages of the invention will be set forth in part in the description which follows and, in part, will be apparent from the description, or may be learned by practice of the invention.

The present invention provides an electrophotographic color image forming apparatus, in which a transfer nip is formed between a photosensitive medium and a belt circulating while contacting the photosensitive medium without pressing the photosensitive medium and the transfer roller to each other.

According to an aspect of the present invention, there is provided an electrophotographic color image forming apparatus having: a plurality of photosensitive media; a plurality of transfer rollers respectively facing the plurality of photosensitive media; and a belt disposed between the photosensitive media and the transfer rollers and circulating while forming a plurality of transfer nips, wherein when a length of the belt between two neighboring transfer nips is B and a distance between a pair of neighboring photosensitive media is C, B is larger than C, and when respective virtual lines connecting centers of the pair of photosensitive media and centers of corresponding transfer rollers are TP lines and a virtual line connecting the centers of the pair of neighboring photosensitive media is a PP line, a pair of neighboring TP lines do not cross the PP line at right angles, and are slanted toward the same side to cross the PP line.

According to one aspect, crossing angles $\theta$ formed by the crossing of the pair of TP lines and the PP line may be the substantially same as each other.

According to one aspect, when a distance between a rotary center of one photosensitive medium and a rotary center of the corresponding transfer roller is L, a diameter of the photosensitive medium is D1, a diameter of the transfer roller is D2, and a thickness of the belt is t, a formula $L>((D1+D2)/2)+t>L\sin\theta$ is satisfied.

According to one aspect, the transfer rollers are not made of an elastomer. According to one aspect, the transfer rollers are made of metal.

According to one aspect, apparatus additionally has a belt driving roller driving the belt to be circulated, wherein when a diameter of the belt driving roller is D0, B is substantially the same as a value of $\pi D0$.

According to one aspect, a value of $B/\pi D0$ satisfies a formula, $0.97 \leqq B/\pi D0 \leqq 1.03$.

According to another aspect of the present invention, there is provided an electrophotographic color image forming apparatus having: a plurality of photosensitive media; a plurality of transfer rollers respectively facing the plurality of photosensitive media; and a belt disposed between the photosensitive media and the transfer rollers and circulating while forming a plurality of transfer nips, wherein when a distance between a center of one photosensitive medium and a center of a corresponding transfer roller is L, a diameter of the one photosensitive medium is D1, a diameter of the corresponding transfer roller is D2, a thickness of the belt is t, and a crossing angle formed by crossing a virtual line connecting a center of the one photosensitive medium and a center of the corresponding transfer roller with a virtual line connecting centers of the one photosensitive medium and a neighboring photosensitive medium is θ, a formula $L>((D1+D2)/2)+t<L\sin\theta$ is satisfied.

According to one aspect, crossing angles θ formed by crossing respective virtual lines connecting centers of neighboring photosensitive media and centers of corresponding transfer rollers with the virtual line connecting the centers of the neighboring photosensitive media are substantially the same.

According to still another aspect of the present invention, there is provided an electrophotographic color image forming apparatus having: a plurality of photosensitive media; a plurality of transfer rollers respectively facing the plurality of photosensitive media; and a belt disposed between the photosensitive media and the transfer rollers and circulating while forming a plurality of transfer nips, wherein when a length of the belt between two neighboring transfer nips is B and a distance between a pair of photosensitive media is C, B is larger than C, and the transfer rollers are made of metal.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION

Figure 1:
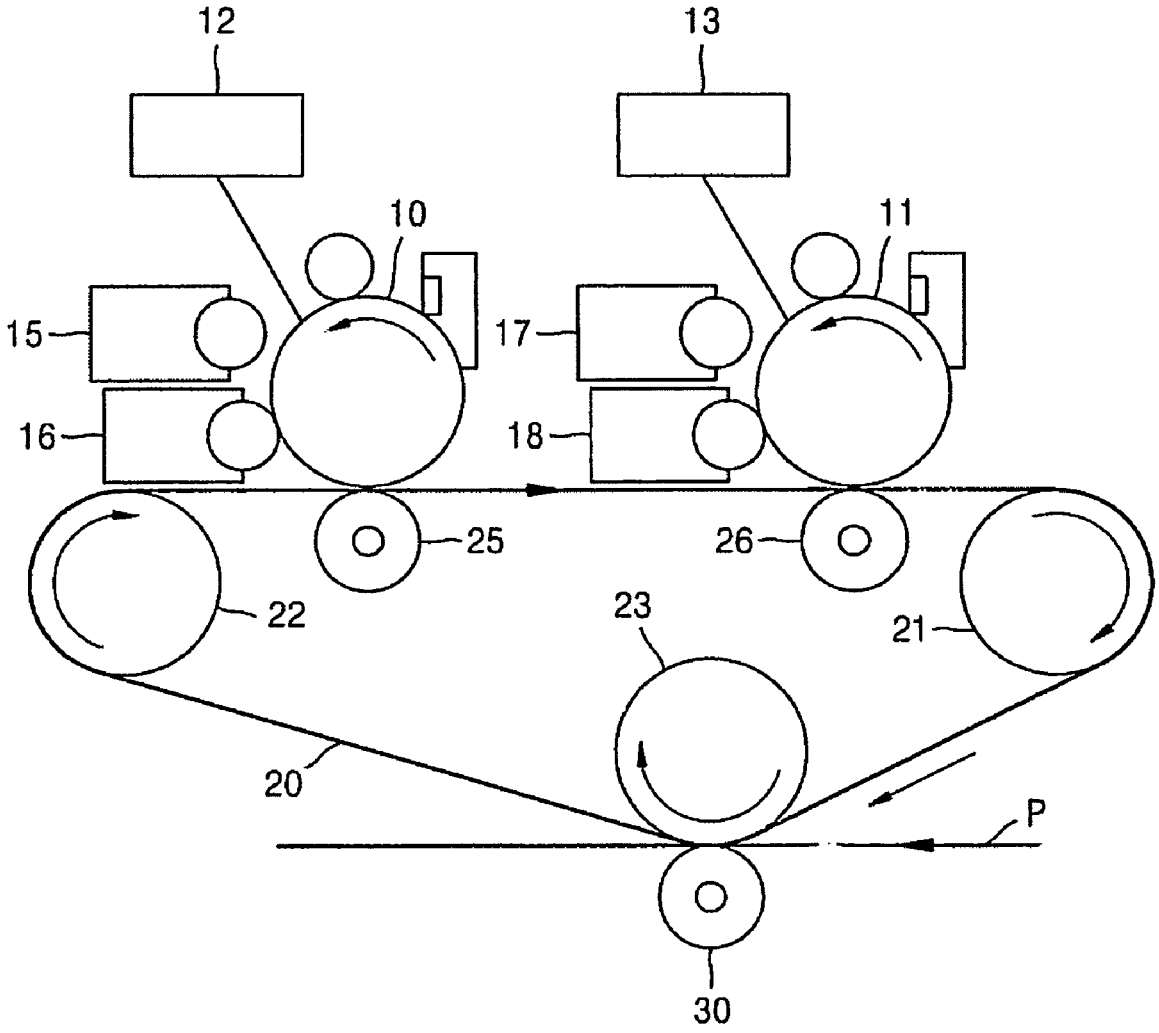
FIG. 1 (PRIOR ART)
FIG. 1 is a schematic cross-sectional view of a conventional electrophotographic color image forming apparatus.

Reference will now be made in detail to embodiments of the present invention, examples of which are illustrated in the accompanying drawings, wherein like reference numerals refer to the like elements throughout. The embodiments are described to explain the present invention by referring to the figures.

Figure 2:
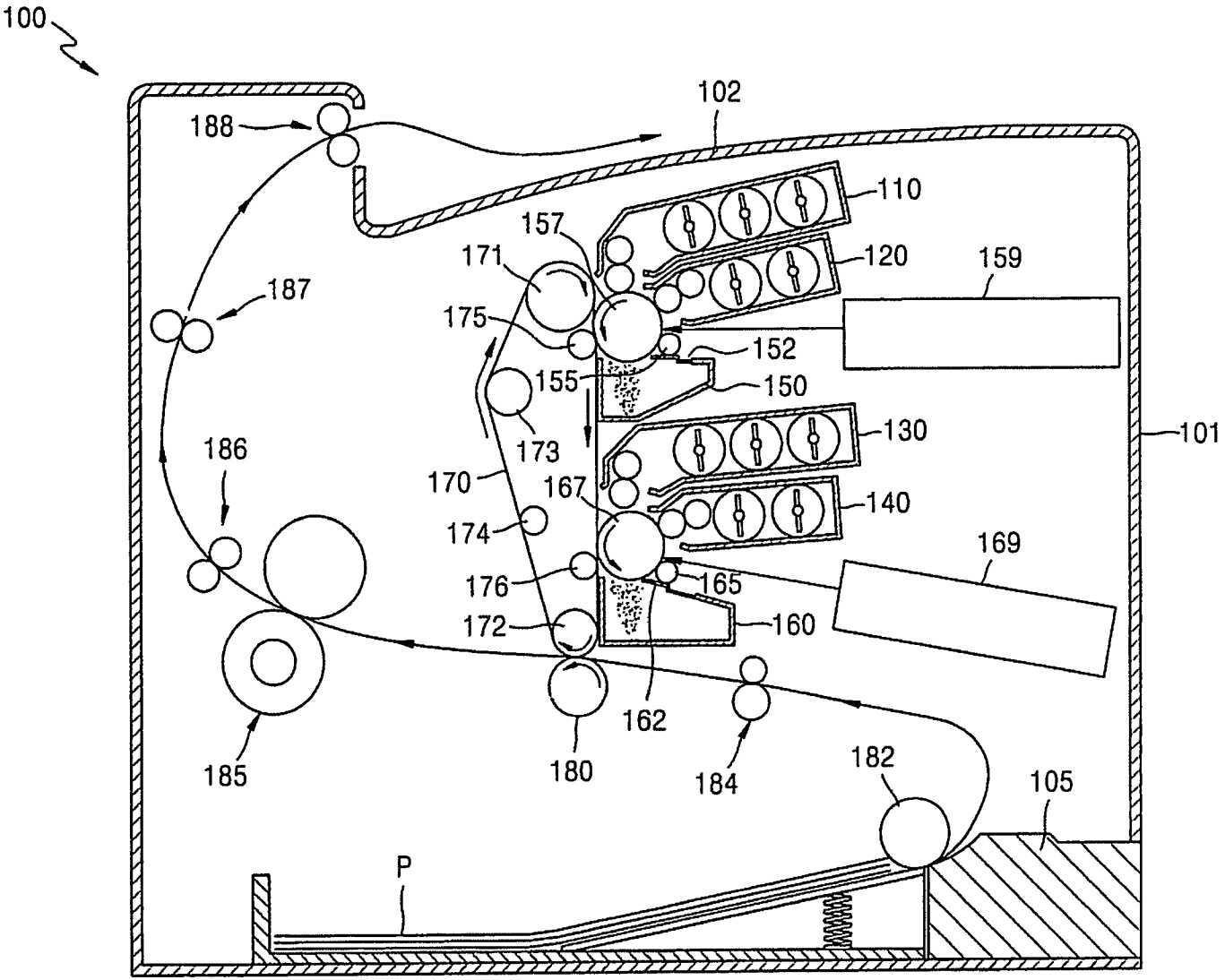
FIG. 2 is a cross-sectional view of an electrophotographic color image forming apparatus according to an embodiment of the present invention.

Referring to FIG. 2, an electrophotographic color image forming apparatus 100 includes four developers 110, 120, 130, and 140 receiving toner in a case 101, two optical scanners 159 and 169, and an intermediate transfer belt 170.

The developers 110, 120, 130, and 140 are cartridge types, which are substituted by new ones when the toner, that is, developing agent, is exhausted. The developers 110, 120, 130, and 140 include the toners of different colors, for example, yellow (Y), cyan (C), magenta (M), and black (K), respectively. Hereinafter, the developer 110 including the Y color toner is referred to as first developer, the developer 120 including the C color toner is referred to as second developer, the developer including the M color toner is referred to as third developer, and the developer including the K color toner is referred to as fourth developer. Each of the developers 110, 120, 130, and 140 includes an agitator, a supplying roller, a developing roller, and a doctor blade to supply the toner to the photosensitive media 157 and 167.

The photosensitive media 157 and 167 are cylindrical metallic drums having respective outer circumferential surfaces, on which a photosensitive material layer is formed, and which are exposed by light scanned from the optical scanners 159 and 169 to form an electrostatic latent image. The first photosensitive medium 157, located at an upper side is charged by a first charging roller 155, and contacts the first and second developers 110 and 120 to develop images by receiving the Y and C color toners. The second photosensitive medium 167, located at a lower side, is charged by a second charging roller 165, and contacts the third and fourth developers 130 and 140 to develop images by receiving M and K color toners.

The optical scanners 159 and 169 are units to scan the lights corresponding to image information onto the photosensitive media 157 and 167, and each optical scanner generally includes a light source formed of laser diode (LD), an optical deflector having a polygonal rotating mirror, and an f-θ lens compensating an aberration of the light that is defectively scanned therein. The first optical scanner 159, located at the upper side, scans the light onto the first photosensitive medium 157, and the second optical scanner 169, located at the lower side, scans the light onto the second photosensitive medium 167.

First and second cleaning blades 152 and 162, which remove used-toner that is not transferred on the intermediate transfer belt 170 by raking the toner from the photosensitive media 157 and 167, are respectively positioned under the first and second photosensitive media 157 and 167. And first and second used-toner storages 150 and 160, storing the removed toner, are also respectively positioned under the first and second photosensitive media 157 and 167.

The intermediate transfer belt 170 is supported by a belt driving roller 171 connected to a motor shaft (not shown) to rotate, a transfer backup roller 172, that is, an idle roller, and first and second supporting rollers 173 and 174, that is, the idle rollers to circulate in a clockwise direction. The first and second photosensitive media 157 and 167 contact the intermediate transfer belt 170 that proceeds from upward to downward to form intermediate transfer nips (Ni, refer to FIG. 3). First and second transfer rollers 175 and 176 that face the first and second photosensitive media 157 and 167 as interposing the intermediate belt 170 therebetween are disposed inside the intermediate transfer belt 170. The first and second transfer roller 175 and 176 support the intermediate transfer nips Ni to be formed.

A third transfer roller 180 is disposed under the transfer backup roller 172 as interposing the intermediate transfer belt 170 therebetween. The third transfer roller 180 is separated from the intermediate transfer belt 170 while the images of four-colors are transferred onto the intermediate transfer belt 170, and contacts the intermediate transfer belt 170 to form a final transfer nip (Nf, refer to FIG. 3) after the full-color image is formed by transferring and overlapping the images of four colors.

In addition, the electrophotographic color image forming apparatus 100 includes: a fusing apparatus 185 fusing the color image onto a sheet of paper (P) using heat and pressure; a paper cassette 105, on which the paper (P) is loaded; a pickup roller 182 picking the sheets of paper from the paper cassette 105 one by one; a paper aligner 184 aligning and conveying the picked paper (P); and first, second, and third discharging rollers 186, 187, and 188 discharging the paper (P), on which the color image is printed, out of the case 101.

Hereinafter, processes of printing the color image of the electrophotographic color image forming apparatus 100 will be described.

The color image information is formed by mixing image information corresponding to the Y, M, C, and K colors. In the present embodiment, the images of four colors are transferred to be overlapped with each other to form the color image, and the color image is transferred onto the paper (P) and fused on the paper to print the color image.

When the light corresponding to the Y color image information is scanned from the first optical scanner 159 onto the first photosensitive medium 157 that is charged to be even potential, the resistance at the portion where the light is scanned is reduced, and electric charges (electrons) attached on the outer circumferential surface of the first photosensitive medium 157 escape. Therefore, electric potential difference is generated between the portion where the light is scanned and the portion where the light is not scanned, and accordingly, an electrostatic latent image is formed on the outer circumferential surface of the first photosensitive medium 157 that rotates. Here, the Y toner is supplied to the first photosensitive medium 157 by the first developer to develop the electrostatic latent image into the Y color visible image. In addition, since the first photosensitive medium 157 rotates, the Y color image is transferred onto the intermediate transfer belt 170 through the intermediate transfer nip (Ni, refer to FIG. 3).

Similarly, the M color image is transferred onto the intermediate transfer belt 170 from the second photosensitive medium 167 and overlaps with the Y color image. After circulating one period, on the intermediate transfer belt 170, the C color image is transferred from the first photosensitive medium 157 and the K color image is transferred from the second photosensitive medium 167, and these are overlapped with each other and the Y and M color images to form the color image.

The paper (P) loaded on the paper cassette 105 is picked by the pickup roller 182 one by one, is aligned by the paper aligner 184, and passes through the final transfer nip (Nf, refer to FIG. 3) between the third transfer roller 180 and the intermediate transfer belt 170, thus the color image is transferred onto the paper (P). The color image is fused onto the paper (P) by the heat and pressure in the fusing apparatus 185, and the paper (P) is discharged onto a discharged paper board 102 out of the case 101 by the discharging rollers 186, 187, and 188.

Figure 3:
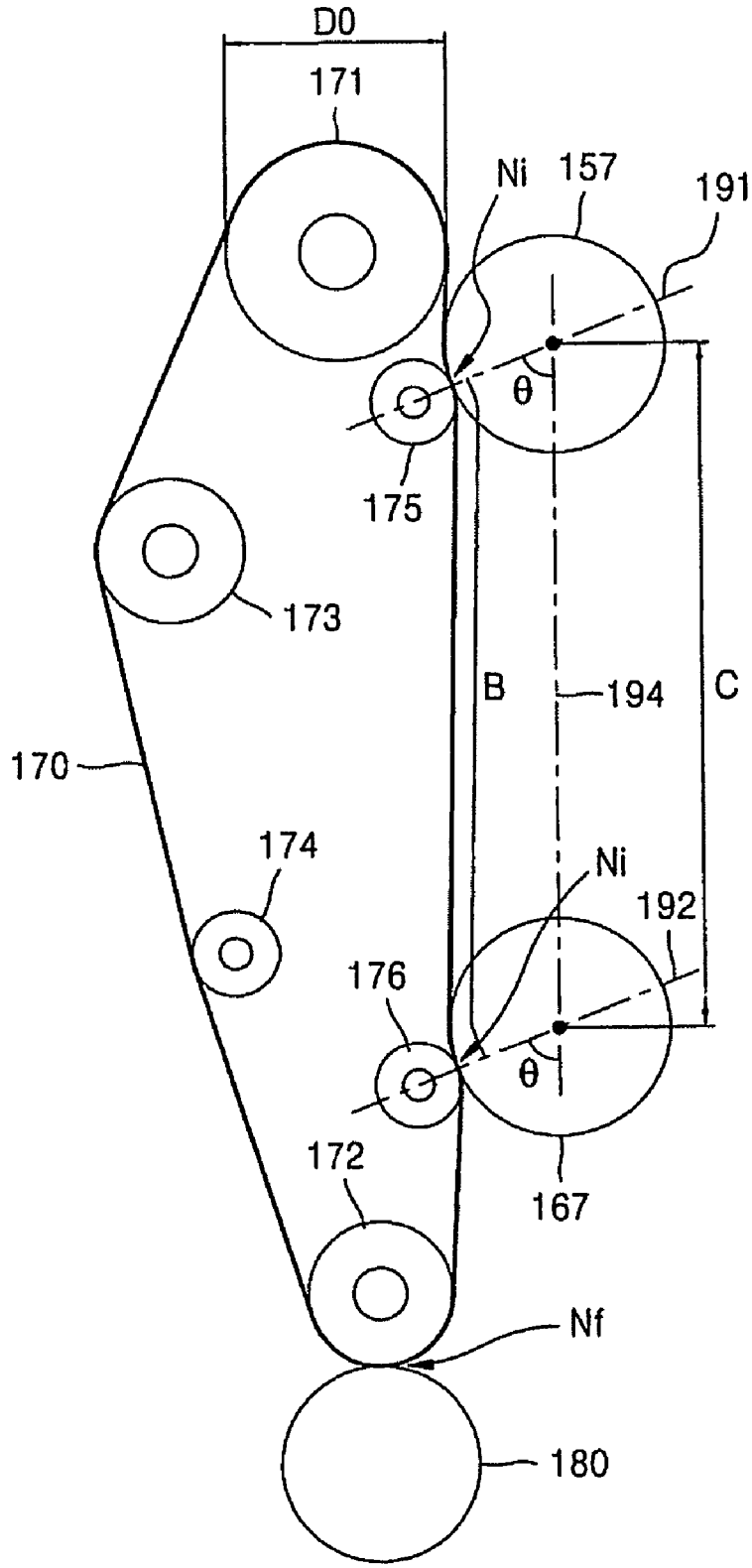
FIG. 3 is an enlarged cross-sectional view of a photosensitive medium and an intermediate transfer belt of FIG. 2.

Referring to FIG. 3, the intermediate transfer belt 170 cannot proceed straightly around the pair of intermediate transfer nips (Ni), but is curved by contacting to the outer circumferential surfaces of the photosensitive media 157 and 167. Therefore, if a length of the intermediate transfer belt 170 between the pair of intermediate transfer nips (Ni) is B, and a distance between the first and second photosensitive media 157 and 167 is C, B is longer than C because of the curved portion. In more detail, C is the same as the distance from a rotating center of the first photosensitive medium 157 to a rotating center of the second photosensitive medium 167.

The first and second transfer rollers 175 and 176 are slanted, or disposed, toward the corresponding first and second photosensitive media 157 and 167 so that the intermediate transfer belt 170 can proceed in a curve by contacting the outer circumferential surfaces of the first and second photosensitive media 157 and 167. In more detail, if virtual straight lines connecting the rotating centers of the photosensitive media 157 and 167 and the rotating centers of corresponding transfer rollers 175 and 176 are TP lines 191 and 192, and a virtual straight line connecting the rotating centers of the photosensitive media 157 and 167 is PP line 194, the pair of TP lines 191 and 192 do not cross the PP line 194 at the right angles, but cross the PP line 194 slanted downward. In addition, crossing angles θ formed by crossing the TP lines 191 and 192 toward the PP line 194 are substantially the same as each other. Here, substantially the same means that the compared items are the same as each other within a tolerance range.

The transfer rollers 175 and 176 are not adhered to the corresponding photosensitive media 157 and 167, and accordingly, the intermediate transfer belt 170 is not pressed when it passes between the transfer rollers 175 and 176 and photosensitive media 157 and 167. The relation will be described using an equation referring to FIG. 4. If a distance between the rotating center of the first photosensitive medium 157 and the rotating center of corresponding first transfer roller 175 is L, a diameter of the first photosensitive medium 157 is D1, a diameter of the first transfer roller 175 is D2, a thickness of the intermediate transfer belt 170 is t, and the crossing angle formed by the crossing of the TP line 191 and the PP line 194 is θ, L is larger than $((D1+D2)/2)+t$ and $((D1+D2)/2)+t$ is larger than $L\sin\theta$. In addition, referring to FIG. 3, the crossing angles θ formed by the crossing of the pair of TP lines 191 and 192 and the PP line 194 are the substantially the same.

Figure 4:
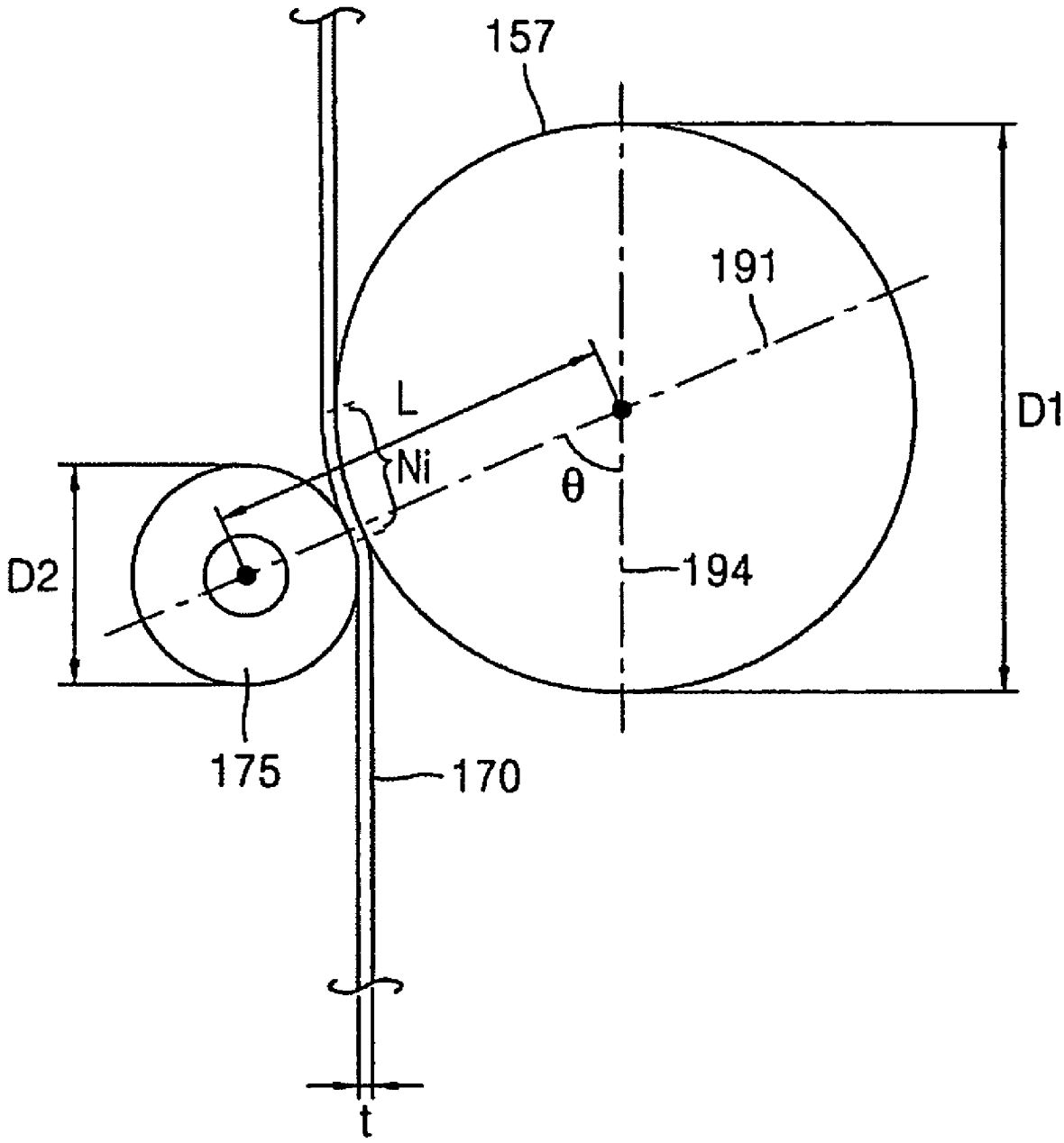
FIG. 4 is an enlarged cross-sectional view of a transfer nip shown in FIG. 3.

According to the above structure, the intermediate transfer belt 170 can widely contact the first photosensitive medium 157 along the outer circumferential surface of the first photosensitive medium 157 even though the intermediate transfer belt 170 is not pressed by the first transfer roller 175, thus the wide intermediate transfer nip (Ni) can be formed and the image transferring efficiency can be improved. In addition, since the first photosensitive medium 157 is not pressed by the first transfer roller 175, irregular impact on the first photosensitive medium 157 and the intermediate transfer belt 170 can be reduced, and accordingly, the generation of transfer defect and image jitter can be reduced. FIG. 4 shows the relation between the first photosensitive medium 157, the first transfer roller 175, and the intermediate transfer belt 170, however, the relation can be similarly applied to the second photosensitive medium 167, the second transfer roller 176, and the intermediate transfer belt 170.

Since the color image forming apparatus 100 of the present invention does not have the structure where the transfer nip is formed by the pressure between the transfer roller and the photosensitive medium, the first and second transfer rollers 175 and 176 can be formed using hard rollers. Therefore, the rollers can be formed of metal, such as steel, since the fabrication costs of the rollers are low and size controlling can be performed easily, instead of using an elastomer that increases the fabrication costs and cannot maintain the accuracy of sizes.

Referring to FIG. 3, according to one embodiment, if a diameter of the belt driving roller 171 is D0, a length of circumference of the belt driving roller 171 is πD0, and the length πD0 is substantially the same as the length B of the intermediate transfer belt 170 between the pair of intermediate transfer nip (Ni). Therefore, even if impacts occur regularly whenever the belt driving roller 171 rotates, the effects of the impacts to the alignment of the images of four colors can be restricted, thereby preventing the image jitter from generating. As described above, 'substantially the same' means that compared items are the same as each other within a tolerance range. And desirably, B/πD0 is maintained within a range of 0.97~1.03.

The electrophotographic color image forming apparatus of the present invention has the following effects. The image transferring efficiency can be improved since the transfer nip is wider than that of the conventional art. In addition, since the transfer roller does not press the photosensitive medium, the impact onto the photosensitive medium and the transfer belt can be reduced, thus the generation of the transfer defect and the image jitter can be prevented. Further, since the transfer roller can be the idle roller, an additional driving unit for the transfer roller is not required. Further still, since the hard roller can be used as the transfer roller, the fabrication costs can be reduced, and maintaining the accuracy of the sizes of elements is more readily accomplished.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An electrophotographic color image forming apparatus, comprising:

a plurality of photosensitive media;

a plurality of transfer rollers respectively facing the plurality of photosensitive media;

a belt disposed between the photosensitive media and the transfer rollers and circulating;

a plurality of transfer nips formed between the photosensitive media and the belt; and a belt driving roller driving the belt to be circulated, wherein when a length of the belt between two neighboring transfer nips is B and a distance between a pair of photosensitive media is C, B is larger than C, wherein when a diameter of the belt driving roller is D0, B is substantially the same as a value of $\pi D0$, and the transfer rollers are made of metal.

2. An electrophotographic color image forming apparatus, comprising:

a plurality of photosensitive media;

a plurality of transfer rollers respectively facing the plurality of photosensitive media;

a belt disposed between the photosensitive media and the transfer rollers and circulating;

a plurality of transfer nips formed between the photosensitive media and the belt; and a belt driving roller driving the belt to be circulated, wherein when a length of the belt between two neighboring transfer nips is B and a distance between a pair of neighboring photosensitive media is C, B is larger than C, wherein when a diameter of the belt driving roller is D0, B is substantially the same as a value of $\pi D0$, and when respective virtual lines connecting centers of the pair of photosensitive media and centers of corresponding transfer rollers are TP lines and a virtual line connecting the centers of the pair of neighboring photosensitive media is a PP line, a pair of neighboring TP lines do not cross the PP line at right angles, and are slanted toward the same side to cross the PP line.

3. The apparatus of claim 2, wherein crossing angles $\theta$ formed by the crossing of the pair of TP lines and the PP line are the substantially same as each other.

4. The apparatus of claim 3, wherein when a distance between a rotary center of one photosensitive medium and a rotary center of the corresponding transfer roller is L, a diameter of the photosensitive medium is D1, a diameter of the transfer roller is D2, and a thickness of the belt is t, a formula $L>((D1+D2)/2)+t>L\sin\theta$ is satisfied.

5. The apparatus of claim 2, wherein the transfer rollers are not made of an elastomer.

6. The apparatus of claim 5, wherein the transfer rollers are made of metal.

7. The apparatus of claim 1, wherein a value of $B/\pi D0$ satisfies a formula $0\ 97 \leqq B/\pi D0 \leqq 1.03$.

8. An electrophotographic color image forming apparatus, comprising:

a plurality of photosensitive media;

a plurality of transfer rollers respectively facing the plurality of photosensitive media; and a belt disposed between the photosensitive media and the transfer rollers and circulating while forming a plurality of transfer nips, wherein when a distance between a center of a first photosensitive medium of the plurality of photosensitive media and a center of a corresponding transfer roller is L, a diameter of the first photosensitive medium is D1, a diameter of the corresponding transfer roller is D2, a thickness of the belt is t, and a crossing angle formed by crossing a virtual line connecting a center of the first photosensitive medium and a center of the corresponding transfer roller with a virtual line connecting centers of the first photosensitive medium and a neighboring photosensitive medium of the plurality of photosensitive media is $\theta$, a formula $L>((D1+D2)/2)+t<L\sin\theta$ is satisfied.

9. The apparatus of claim 8, wherein crossing angles $\theta$ formed by crossing respective virtual lines connecting centers of neighboring photosensitive media and centers of corresponding transfer rollers with the virtual line connecting the centers of the neighboring photosensitive media are substantially the same.

10. The apparatus of claim 8, wherein the transfer rollers are not made of an elastomer.

11. The apparatus of claim 10, wherein the transfer rollers are made of metal.

12. The apparatus of claim 8, further comprising:

a belt driving roller driving the belt to be circulated, wherein when a diameter of the belt driving roller is D0, B is substantially the same as a value of $\pi D0$.

13. The apparatus of claim 12, wherein a value of $B/\pi D0$ satisfies a formula, $0.97 \leqq B/\pi D0 \leqq 1.03$.

14. An electrophotographic color image forming apparatus, comprising:

an intermediate transfer belt;

a plurality of photosensitive media;

a plurality of transfer rollers respectively facing the plurality of photosensitive media, the intermediate transfer belt being interposed therebetween; and a belt driving roller driving the intermediate transfer belt to circulate, wherein the intermediate transfer belt circulates and contacts the plurality of the plurality of photosensitive media, a plurality of transfer nips formed between the photosensitive media and the intermediate transfer belt, wherein a transfer nip of the plurality of transfer nips is formed between a photosensitive medium of the plurality of photosensitive media and the intermediate transfer belt that circulates while contacting the photosensitive medium, wherein the intermediate transfer belt circulates while contacting the photosensitive medium without the photosensitive medium and the transfer roller being pressed to each other, and wherein when a length of the intermediate transfer belt between two neighboring transfer nips is B and a distance between a pair of neighboring photosensitive media is C, B is larger than C, and wherein a length of the intermediate transfer belt between two adjacent transfer nips is substantially the same as a circumference of the belt driving roller, to reduce an effect on alignment of the images transferred from the plurality of photosensitive media from an impact on the intermediate transfer belt due to rotation thereof.

15. The electrophotographic color image forming apparatus according to claim 14, wherein a length of the intermediate transfer belt between two adjacent transfer nips is greater than a distance between rotary centers of corresponding photosensitive media.

16. The electrophotographic color image forming apparatus according to claim 14, wherein a line connecting a rotary center of the at least one transfer roller and a rotary center of the corresponding photosensitive medium forms a non-right angle with a line connecting the rotary center of the corresponding photosensitive medium with a rotary center of an adjacent photosensitive medium.

17. The electrophotographic color image forming apparatus according to claim 14, wherein:

respective lines connecting rotary centers of adjacent photosensitive media and centers of corresponding transfer rollers form respective non-right angles with a line connecting the rotary centers of the adjacent photosensitive media, and the respective non-right angles are substantially the same.

18. The electrophotographic color image forming apparatus according to claim 14, wherein a distance, L, between a rotary center of the at least one transfer roller and a rotary center of the corresponding photosensitive medium is greater than a sum of the respective radii of the at least one transfer roller and the corresponding photosensitive medium and a thickness of the intermediate transfer belt.

19. The electrophotographic color image forming apparatus according to claim 18, wherein:

$\theta$ is a non-right angle formed between a line connecting a rotary center of the corresponding photosensitive medium with a rotary center of an adjacent photosensitive medium and a line connecting a rotary center of the at least one transfer roller and the rotary center of the corresponding photosensitive medium; and the sum is greater than a product of L and $\sin\theta$.

20. The etectrophotographic color image forming apparatus according to claim 14, wherein the transfer rollers are not made of an elastomer.

21. The electrophotographic color image forming apparatus according to claim 14, wherein the transfer rollers are made of metal.

22. The electrophotographic color image forming apparatus according to claim 14, wherein a ratio of the length of the intermediate transfer belt between two adjacent transfer nips and the circumference of the belt driving roller is approximately within a range of 0.97 to 1.03.

23. The electrophotographic color image forming apparatus according to claim 14, wherein the at least on transfer roller is an idle roller.

* * * * *

UNITED STATES PATENT AND TRADEMARK OFFICE

CERTIFICATE OF CORRECTION

PATENT NO. : 7,450,893 B2
APPLICATION NO. : 11/243318
DATED : November 11, 2008
INVENTOR(S) : Byung-sun Ahn et al.

It is certified that error appears in the above-identified patent and that said Letters Patent is hereby corrected as shown below:

Column 8, Line 6, change “formula 0 97” to --formula, 0.97--.

Column 8, Line 54, before “photosensitive” delete “the plurality of”.

Signed and Sealed this

Seventeenth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,450,893 B2
APPLICATION NO. : 11/243318
DATED : November 11, 2008
INVENTOR(S) : Byung-sun Ahn et al.

It is certified that error appears in the above-identified patent and that said Letters Patent is hereby corrected as shown below:

Column 3, Lines 11-12, change "$L > ((D1 + D2)/2) + t < L\sin\theta$"
to --$L > ((D1 + D2)/2) + t > L\sin\theta$--

Column 8, Line 26, change "$L > ((D1 + D2)/2) + t < L\sin\theta$"
to --$L > ((D1 + D2)/2) + t > L\sin\theta$--

Signed and Sealed this

Twenty-seventh Day of July, 2010

David J. Kappos

David J. Kappos
*Director of the United States Patent and Trademark Office*